US009345355B2

(12) United States Patent
San Nicolas

(10) Patent No.: US 9,345,355 B2
(45) Date of Patent: May 24, 2016

(54) GARMENT HANGER ATTACHMENT

(71) Applicant: Jessica del Rosario San Nicolas, Grandview, MO (US)

(72) Inventor: Jessica del Rosario San Nicolas, Grandview, MO (US)

( * ) Notice: Subject to any disclaimer, the term of this patent is extended or adjusted under 35 U.S.C. 154(b) by 0 days.

(21) Appl. No.: 14/466,304

(22) Filed: Aug. 22, 2014

(65) Prior Publication Data

US 2014/0361054 A1 Dec. 11, 2014

Related U.S. Application Data

(63) Continuation-in-part of application No. 13/021,748, filed on Feb. 5, 2011, now abandoned.

(51) Int. Cl.
*A47G 25/44* (2006.01)
*A47G 25/20* (2006.01)

(52) U.S. Cl.
CPC ..... *A47G 25/20* (2013.01); *A47G 25/44* (2013.01); *A47G 25/442* (2013.01)

(58) Field of Classification Search
CPC ..... A47G 25/20; A47G 25/30; A47G 25/442; A47G 25/443; A47G 25/44; A47F 7/19; A41D 27/22
USPC ..... 223/85, 89, 94
See application file for complete search history.

(56) References Cited

U.S. PATENT DOCUMENTS

| | | | | |
|---|---|---|---|---|
| 779,062 | A * | 1/1905 | Beatty | 223/94 |
| 2,283,530 | A * | 5/1942 | Bohachef | 223/91 |
| 2,421,433 | A * | 6/1947 | Poole | 223/88 |
| 5,476,199 | A * | 12/1995 | Halverson et al. | 223/94 |
| 6,164,504 | A * | 12/2000 | Richard | 223/94 |
| 8,256,650 | B2 * | 9/2012 | Sokol | 223/94 |
| 2013/0264362 | A1 * | 10/2013 | Watanabe | 223/85 |
| 2013/0320051 | A1 * | 12/2013 | Madden | 223/85 |

FOREIGN PATENT DOCUMENTS

GB 2262224 A * 6/1993

* cited by examiner

*Primary Examiner* — Ismael Izaguirre
(74) *Attorney, Agent, or Firm* — Invention Protection Associates, LLC

(57) ABSTRACT

A garment hanger attachment having a flexible outer tube element and an inner partial tube element for securely attaching to a garment hanger arm and effectively lengthening and broadening the support area of a garment hanger arm so as to both inhibit crease and pucker formation in a hanged garment and enable the hanger to support larger and heavier garments than it otherwise could.

2 Claims, 4 Drawing Sheets

GARMENT HANGER ATTACHMENT

This application is a continuation-in-part that claims the benefit of nonprovisional application Ser. No. 13/021,748. Furthermore, application Ser. No. 13/021,748 is hereby incorporated by reference.

BACKGROUND

The present invention generally relates to garment hangers, and it is specifically directed to devices for attaching to hangers in order to prevent unsightly creasing and puckering along the shoulder areas of hanged garments that can occur due to the width or diameter of a hanger's arms being considerably less than the width of human shoulders for which a particular garment is intended (a problem that is exacerbated by increased garment weight) or due to incongruence between the respective lengths of a hanger's arms and a garment's shoulders.

Garment hangers come in a variety of styles and sizes which are typically fabricated of either metal wire, plastic or wood. In the dry cleaning industry, for example, cylindrical wire hangers are most often used to mount cleaned garments on because of their relatively low cost of manufacture. Moreover, for simplicity, a dry cleaner will typically use only one size (in terms of wire diameter & shoulder length) of hanger for all of its cleaned garments. However, the proposition of using a single model of hanger to support each of many garments of widely varying masses, shoulder dimensions, and material impressionability can be problematic. For example, it is generally undesirable to use a wire hanger to support a men's suit jacket because the small gauge (diameter) of the hanger wire, coupled with the weight of the jacket, may form a crease running along the shoulder area of the jacket. Furthermore, if the hanger arms are shorter than the jacket's shoulder length, puckers may form at the respective spots along each of the jacket arms where the hanger arm ends and the jacket arm, therefore, abruptly begins freely hanging down under its own weight, unsupported by hanger arm. In fact, the jacket may easily slide off the hanger entirely if too much arm length is unsupported. To address these and similar hanger-garment size incompatibility issues, a plethora of hanger attachment devices have been developed in the prior art.

U.S. Pat. No. 6,053,379 to Balph discloses a hanger sleeve extension comprising a tubular body formed by a hanger engagement portion for sliding over a hanger arm, as well as a sleeve insert portion that extends outward from the engagement portion. In a preferred embodiment, the hanger engagement portion is simply a fabric sleeve with fastening cords at its proximal end, while the sleeve insert portion comprises a fabric-covered, high-density synthetic material that exhibits some degree of rigidity. However, the present inventor recognizes a deficiency in the Balph device with regard to the tedious need for a user to tie each of two attachments' tie cords to the base of the hanger hook (and subsequently untie them when it is necessary to remove the attachments) in order to prevent the attachments from sliding off the hanger as a garment is being removed.

U.S. Pat. No. 6,267,275 to Murray discloses a unitary, elongated, flexible body of resilient foam material, such as flexible polyurethane foam, that features a half-slit running longitudinally along the body and a shorter, longitudinally centered, through-slit. The through-slit allows a hanger hook to protrude up through the body while the resilient material conforms to hanger arms enveloped within the half-slit. In a preferred embodiment, a flocking material covers the resilient foam. The present inventor recognizes, however, that while the Murray device may certainly be effective in preventing the kind of longitudinally oriented creases that a wire hanger might create along the length of a garment shoulder, it still may not prevent the forming of puckers, or even lateral creases, in larger garments having shoulder length dimensions greater than the length of supporting hanger arms. That is because the outer segment of garment shoulder that is not undergirded by hanger arm and/or highly rigid foam material will be left to hang and will abruptly bend downward and form a pucker or lateral crease at the point which that underlying, sufficiently rigid support ends.

If, on the contrary, an embodiment of the Murray device comprises a foam body that is both long enough to extend as far beyond the length of a standard-sized hanger arm as is necessary to span the entire shoulder length of a broad-shouldered, heavy garment and rigid enough to, in fact, support that outer shoulder area of the garment and prevent it from abruptly bending at the point where the hanger arm ends, then that foam body may tend to be too long and inflexible to stow into many suitcases and other travel compartments. So, in the judgment of the present inventor, the Murray device presents an undesirable tension between (a) compatibility with a wide range of garments and (b) efficient storability and/or portability.

U.S. Pat. No. 6,840,413 to Cameron, et al. describes a hanger-mountable device for preventing creases and wrinkles that is formed by an elongate, injection molded article having a cylindrical exterior surface and a length-running opening that leads into a hollow interior which is slightly smaller in diameter than is the hanger arm to which the device is to attach. In some embodiments, this interior hollow space has a cylindrical profile so as to conform to cylindrical wire or plastic hangers, and in other embodiments it has a different profile (e.g., rectangular) for accommodating non-cylindrical profiled hanger arms. Furthermore, in addition to having the appropriate shape, the molded interior space should be precisely dimensioned to snuggly conform to a particular hanger's arms.

Nevertheless, the present inventor recognizes that while the Cameron device can effectively prevent creasing and wrinkling of clothing draped along the lengths of both the crossbar and arm sections of hangers, it is not suitable for addressing the puckering and creasing that, for example, the Murray device addresses by extending a hanger's support surface beyond the length of its arms. In fact, the Cameron patent discloses and explicitly claims that the device is to be modified by way of cutting off the portion of the device which exceeds the length of the hanger arm that it is to be installed onto. Moreover, if one were to simply imagine a Cameron-like device that did extend beyond the length of hanger arms to provide extended, non-creasing support for garment arms, one could just as easily imagine the potential for such a device to become detached from a hanger arm due to the weight of the clothing material.

More specifically, vertical load applied, by clothing material, along the span of such an attachment device which extends beyond its span of attachment to a hanger arm will create torque on that device. In other words, the portion of such an attachment device which is attached to hanger arm will be urged away from that arm. Considering that such a device features a slit opening and is, likely, flexible enough for the opening to momentarily expand to receive a hanger arm being intentionally pressed into it or to release a hanger arm being intentionally pulled out of it, one could expect a similar widening of that opening and release of the device caused by torque generated by the sheer weight of clothing acting on the extension part of such a device. This could obviously result in such a device accidentally detaching from a hanger.

Consequently, the present inventor appreciates a need for a hanger attachment device that, in view of prior art, is improved relative to its ability to be used with hangers of many different specifications and is effective in supporting, without creasing or puckering, garments of a wide range of shoulder lengths while remaining less bulky and more efficiently storable than are many of its prior art counterparts. The present inventor also appreciates the need for such a hanger attachment device to be configured in a way that secures it to hanger sufficiently to prevent unwanted detachment caused by garment-applied torque. The present invention for a hanger attachment device substantially fulfills these needs.

SUMMARY

It is an object of the present invention to provide a garment hanger attachment device that effectively widens the contact surface area of a hanger arm and thereby prevents the introduction of shoulder crease impressions into hanged clothes that might otherwise be formed by the smaller diametered hanger arm that the device attaches over.

It is another object of the invention to provide a garment hanger attachment device that, in effect, lengthens a hanger arm and thereby prevents hanged upper body garments having broader shoulder dimensions from developing puckers that the hanger alone might otherwise cause to be formed at a point along the garment shoulder inward of the arm seam due to the garment abruptly bending over at and hanging from the distal end of the insufficiently long hanger arm.

It is another object of the present invention to provide a garment hanger attachment device that includes an inexpensive to manufacture, easy to assemble and simple to manipulate mechanism for reliably securing the device to the arm of a hanger such that the device cannot be torque off of the hanger arm by the weight of the garment that it is supporting.

Finally, it is yet another object of the invention to provide a garment hanger attachment device that is rigid enough to support heavier garments (e.g., leather jackets), but is structured so as to enable a single unit of the device to frictionally fit onto hanger arms of a range of cross-sectional profiles (e.g., cylindrical and non-cylindrical) and diameters.

In one aspect of the present invention, the attachment device comprises an elongate, flexibly rigid piece of tubular material that has a slit opening which spans a part of the length of the tube. This piece constitutes an outer tube portion of the present device. Typically, the interior and exterior surfaces of this tube are cylindrical, but they can have other geometric contours within the scope and spirit of the invention. In any event, the slit opening can be easily pried further open to receive and release any conventional wire hanger.

In another aspect of the present invention, the attachment device also includes a partial tubular piece, or "sleeve," that fits telescopically within the aforementioned outer tube. The sleeve slides within the outer tube so that it can cover the slit opening after the device is attached to a hanger arm. This will prevent the device from being unintentionally detached from the hanger.

DETAILED DESCRIPTION OF THE PREFERRED EMBODIMENTS

Figure 1:
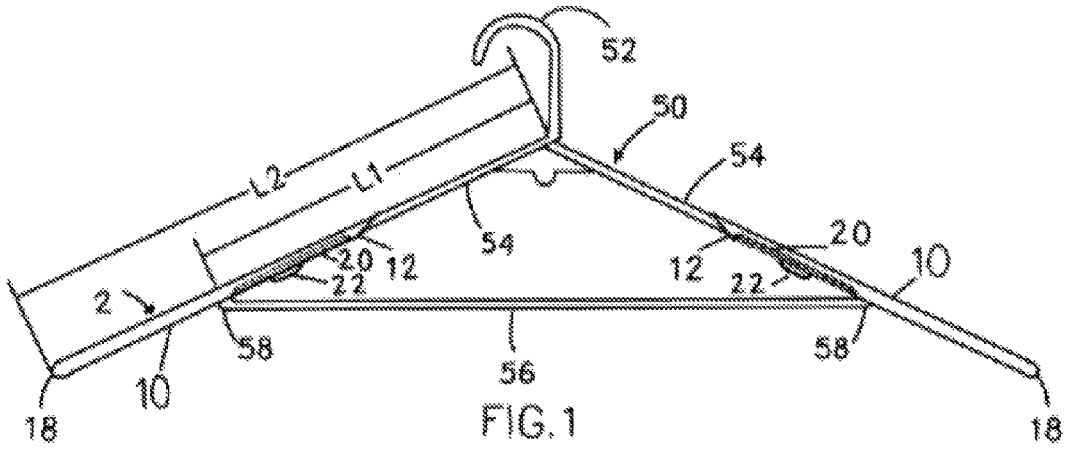
FIG. 1 is an elevational view of a pair of hanger attachment devices in accordance with the present disclosure, the devices being shown mounted to the arms of a garment hanger.
Figure 2:
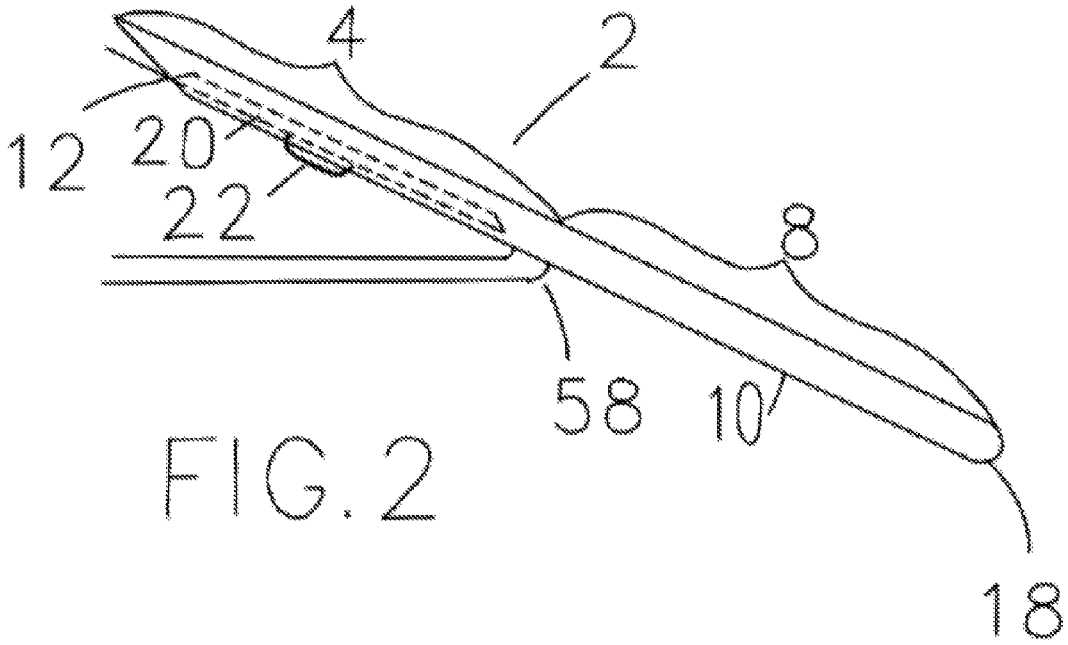
FIG. 2 is a partial elevational view of an attachment device of FIG. 1.

Referring now to FIG. 1, there are illustrated two units of the present attachment device 2 mounted to the sloping arms 54 of a typical garment hanger 50. It should be noted that, although FIGS. 1 & 2 depict a molded plastic, closed hanger ("closed" in that it includes a crossbar 56 which forms a triangular enclosure with the two arms 54 that lead downwardly away from its hook 52), the attachment 2 is not limited to use with only hangers constructed of plastic or having a closed configuration. In fact, the present inventor anticipates that the instant device 2 will primarily be mounted to the type of thin gauge wire hangers commonly used by dry cleaning establishments. Nevertheless, as shown in FIG. 2, the attachment 2 is an elongate device that mounts to the hanger arm 54 throughout an "engagement segment" 4, and it has an "extension segment" 8 which effectively extends the hanger's garment support surface from the length L1 of the hanger arm 54 to the combined length L2 of the hanger arm 54 and attachment extension segment 8. In a preferred embodiment, each of these segments 4, 8 makes up approximately half the length of the attachment device 2. Typically, the engagement segment is [substantially] linear, while the extension segment 8 is [substantially] arcuate, as is depicted in FIG. 3 and indicated in FIGS. 1 & 2.

Figure 3:
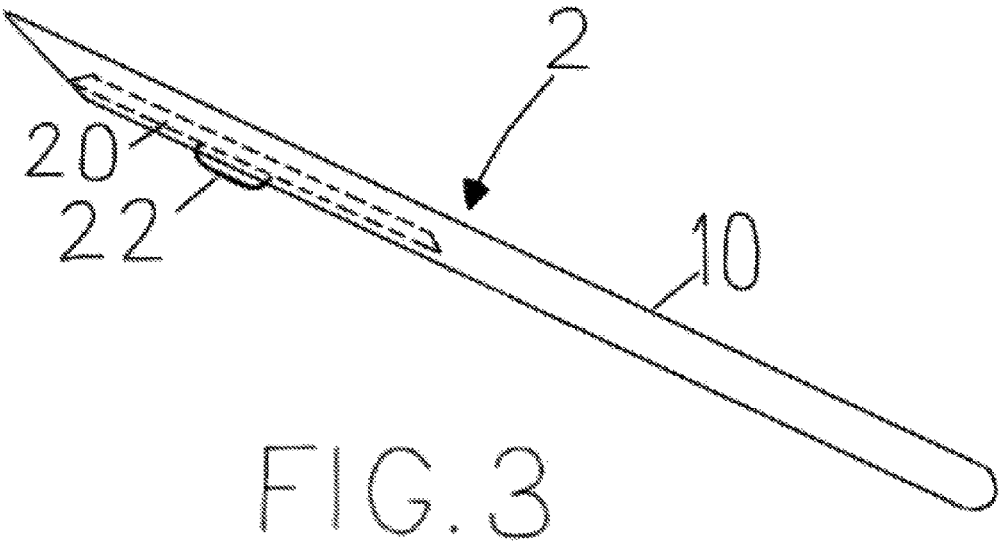
FIG. 3 is a side elevational view of an attachment device in accordance with the present disclosure.

A preferred embodiment of the attachment 2, as can be most clearly seen in FIG. 3, comprises two main components: a flexible outer tube 10 and a partially tubular sleeve 20 that telescopically fits into the outer tube 10 and slides along its inner surface. Typically, the outer tube 10 is made of a plastic or rubber material that enables the tube 10 to flex and its extension segment 8 to arc [further] downward under a sufficient load (e.g., the weight of a men's jacket), but also causes it to substantially rebound back to its original, less arced [or straight] posture when the load is removed.

Figure 5:
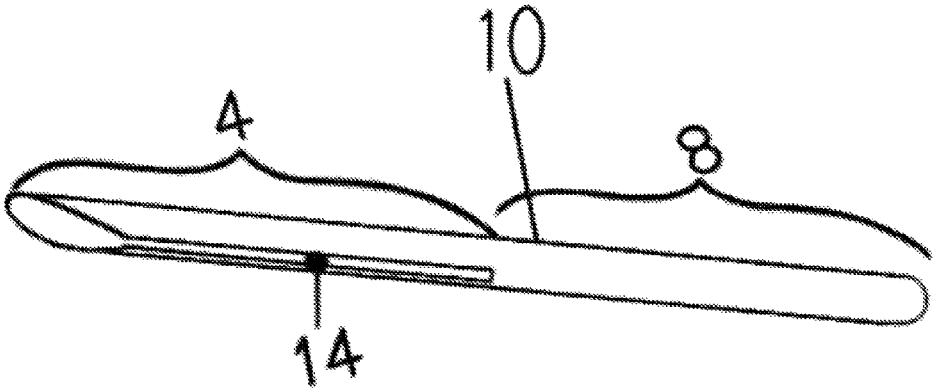
FIG. 5 is a bottom perspective view of the outer tube element of attachment device in accordance with the present disclosure.

As can be seen in FIG. 5, the outer tube 10 has a slit opening 14 formed along a portion of the length of its bottom surface. More specifically, this opening 14 resides in the tube's engagement segment 4, so that that segment 4 can receive a hanger arm 54. In a preferred embodiment, the opening 14 does not extend into the extension segment 8, and the extension segment 8 is, therefore, either a complete cylindrical enclosure or a solid tubular element. However, it should be noted that the slit 14 can extend a greater proportion of outer tube's length, and even its entire length, in alternative embodiments.

The slit opening 14 is narrower then the gauge of typical hanger wire, but it momentarily widens when an opening force is applied to the engagement segment 4 by virtue of pressing through the slit 14 a hanger arm 54 that has a diameter greater than the slit width. The, proximal end 12 of the outer tube 10 is beveled to make a hanger arm 54 more easily insertable into the engagement segment 4. Its distal end 18 can be closed and rounded so as to not form a sharp edge capable of damaging a garment, but that is not an essential configuration.

Figure 4:
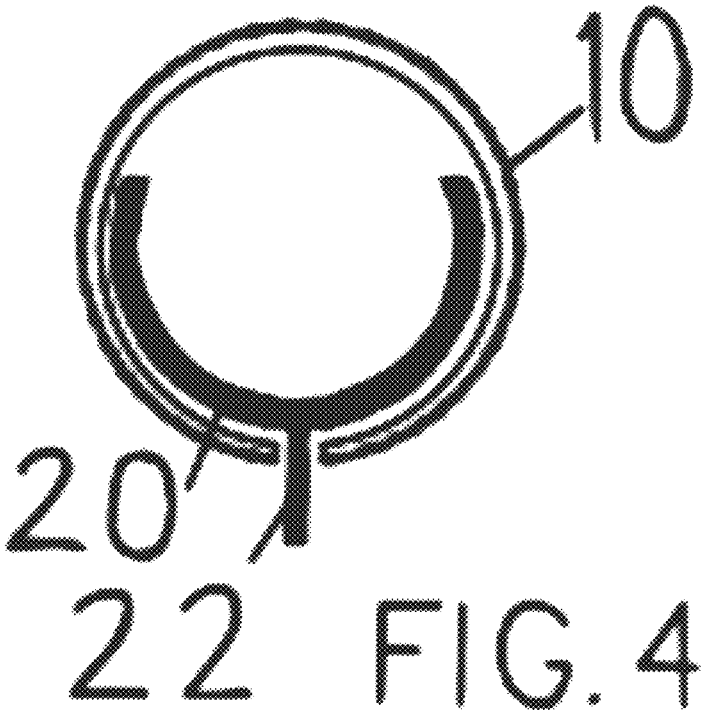
FIG. 4 is a cross-sectional view of an attachment device in accordance with the present disclosure.

The sleeve 20 is of a cross-sectional profile and dimensions that cause it to telescopically fit into at least the engagement section 4 of the outer tube 10. In other words, the sleeve 20 should have an outer surface diameter approximately equal to the inner surface diameter of the outer tube 10, as can be best seen in FIG. 4. It is envisioned that the sleeve 20 is a half or partial tube with an open top section, formed along its length, of greater width than the slit opening 14 formed along the outer tube 10. Radially centered along the bottom of the sleeve 20 is a finger tab 22. When the sleeve 20 is positioned within the outer tube 10, the tab 22 protrudes through the slit opening 14 to enable a user to slide the sleeve 20 back and forth within the outer tube 10. The tab's positioning within the slit 14 also keeps the sleeve 20 from rotating within the outer tube 10 so that any portion of the length of the sleeve 20 that is within the outer tube 10 will be effectively closing the slit opening 14 along that span. This prevents a hanger arm 54 from becoming dislodged from the attachment 2.

The sleeve 20 is inserted into and removed from the outer tube 10 through the tube's proximal end 12. The extent to which it can be slid linearly into the outer 10 is limited by the length of the slit opening 14. Preferably, the slit opening 14 terminates and the tab 22 is positioned along the length of the sleeve 20 such that minimal length of the sleeve 20 is able to extend into the extension segment 8 of the outer tube 10 which is downwardly curved and/or subject to bend when supporting a garment (because the tab 22 is retained at the distal end of the slit opening 14).

Aspects of various embodiments of the present invention that are not recited above or claimed below may be noted from observing the illustrations included herein.

What is claimed is:

1. A device for attaching to an arm of a garment hanger having a hook and two arms extending downwardly away from the hook, the device comprising:

a flexible outer tube having a longitudinal slit opening formed therealong, wherein the slit is for receiving a hanger arm so that the tube may form a garment support surface, separate from that of the hanger, which extends beyond the length of a hanger arm disposed therein; and a partially tubular sleeve that telescopically fits and is longitudinally slidable within the outer tube to close the slit opening, the sleeve having a tab formed therealong, wherein the tab is configured to protrude through and slide linearly within the slit opening while inhibiting rotational movement of the sleeve when the sleeve is disposed telescopically within the outer tube;

wherein the outer tube is defined by an engagement segment for telescopically disposing a hanger arm within an extension segment that extends beyond the length of a hanger arm in which the engagement segment is so disposed, wherein the slit opening resides throughout the length of the engagement segment, but does not reside in the extension segment.

2. The device of claim 1, wherein said engagement segment is substantially straight and said extension segment is substantially arcuate.

* * * * *